US006863263B2

(12) United States Patent
Marchetti

(10) Patent No.: US 6,863,263 B2
(45) Date of Patent: Mar. 8, 2005

(54) DEVICE FOR LOCKING THE DESCENT OF THE REEL-HOLDER TROLLEY IN A FIXED COLUMN WINDING APPARATUS

(76) Inventor: Antonio Marchetti, Via Jacopo Palma, 17, Milan (IT), 20146

( * ) Notice: Subject to any disclaimer, the term of this patent is extended or adjusted under 35 U.S.C. 154(b) by 86 days.

(21) Appl. No.: 10/337,325

(22) Filed: Jan. 7, 2003

(65) Prior Publication Data

US 2003/0127553 A1 Jul. 10, 2003

(30) Foreign Application Priority Data

Jan. 7, 2002 (IT) ..... MI2002A0006

(51) Int. Cl.[7] ..... B66D 1/00
(52) U.S. Cl. ..... 254/264; 187/367; 187/371
(58) Field of Search ..... 254/264; 187/367, 187/356, 359, 371, 374

(56) References Cited

U.S. PATENT DOCUMENTS

| | | | | | |
|---|---|---|---|---|---|
| 106,284 | A | * | 8/1870 | Pollard | 187/367 |
| 579,797 | A | | 3/1897 | Gray | |
| 855,646 | A | | 6/1907 | Lehn | |
| 912,173 | A | | 2/1909 | Rowley | |
| 981,908 | A | * | 1/1911 | Baird | 187/367 |
| 1,274,746 | A | * | 8/1918 | Murphy | 187/372 |
| 1,660,064 | A | * | 2/1928 | Bellowons et al. | 187/367 |
| 1,696,557 | A | * | 12/1928 | Tomilin | 187/367 |
| 4,745,726 | A | | 5/1988 | Rosenthal et al. | 53/77 |
| 5,234,079 | A | * | 8/1993 | Nomura | 187/250 |
| 5,738,017 | A | * | 4/1998 | Behringer | 104/250 |
| 6,206,366 | B1 | | 3/2001 | Schmid | 271/217 |

* cited by examiner

*Primary Examiner*—Emmanuel Marcelo
(74) *Attorney, Agent, or Firm*—Jacobson Holman PLLC

(57) ABSTRACT

A device for locking the descent of a reel-holder trolley along a sliding guide under the control of a traction belt in a fixed column winding apparatus. The device includes a clamp connection between belt and trolley, that is attached to the belt and is mobile with respect to the trolley between a first raised position in which the clamp is held by the upward traction exerted by the belt and holds in turn a pair of levers in such a position as not to interfere with side walls of the sliding guide of the trolley and a second position in which it moves automatically by gravity in the event the traction of the belt is released and in which it permits the pair of levers to be elastically stressed in such a position to enter transversally openings of the side walls of the sliding guide of the trolley to lock the descent of the latter.

3 Claims, 4 Drawing Sheets

DEVICE FOR LOCKING THE DESCENT OF THE REEL-HOLDER TROLLEY IN A FIXED COLUMN WINDING APPARATUS

FIELD OF THE INVENTION

The present invention refers to a device for locking the descent of the reel-holder trolley in a fixed column and rotating platform winding apparatus.

BACKGROUND OF THE INVENTION

For winding film or similar tape around an article or group of articles piled on a pallet or other suitable support, winding equipments that are made up of a motorized rotating platform for the support of the articles and of a fixed column for supporting a reel of windable film placed on a trolley that slides along a fixed vertical guide fastened to a side of the column are usually employed.

The ascent of the reel-holder trolley is carried out by a belt activated by a motorized winch positioned on the top of the column, while the descent comes about essentially by gravity combined with the progressive release of the belt by the motorized winch.

It is obviously important to guarantee that any eventual breakage of the belt or breakdown of the winch that holds it does not cause the trolley to suddenly fall with consequent disastrous and dangerous effects for the operators.

The known equipments of this type therefore includes devices for locking the descent of the reel-holder trolley that intervene immediately in the event of breakage of the belt or similar effect. Moreover these devices are extremely complicated.

SUMMARY OF THE INVENTION

The object of the present invention is to produce a locking device for the reel-holder trolley that is of simple construction and at the same is efficient and operates safely.

In accordance with the invention this object is achieved with a device characterized in that it comprises a connection clamp between belt and trolley that is attached to the belt and is mobile in respect to the trolley between a first raised position in which the clamp is held by the upwards traction exerted by the belt and holds in turn a pair of levers in such a position as not to interfere with the side walls of the sliding guide of the trolley and a second position in which it moves automatically by gravity in the event the traction of the belt is released and in which said pair of levers can be elastically stressed in such a position that they transversally enter openings of the side walls of the sliding guide of the trolley to lock the descent of the latter.

With a very mechanically simple device safe and efficient locking of the descent of the trolley is thus achieved in the event of breakage of the belt or a similar event.

BRIEF DESCRIPTION OF THE DRAWINGS

The characteristics of the present invention will appear evident from the following detailed description of an embodiment thereof illustrated as non-limiting example in the enclosed drawings wherein.

DETAILED DESCRIPTION OF THE REFERRED EMBODIMENTS

Figure 1:
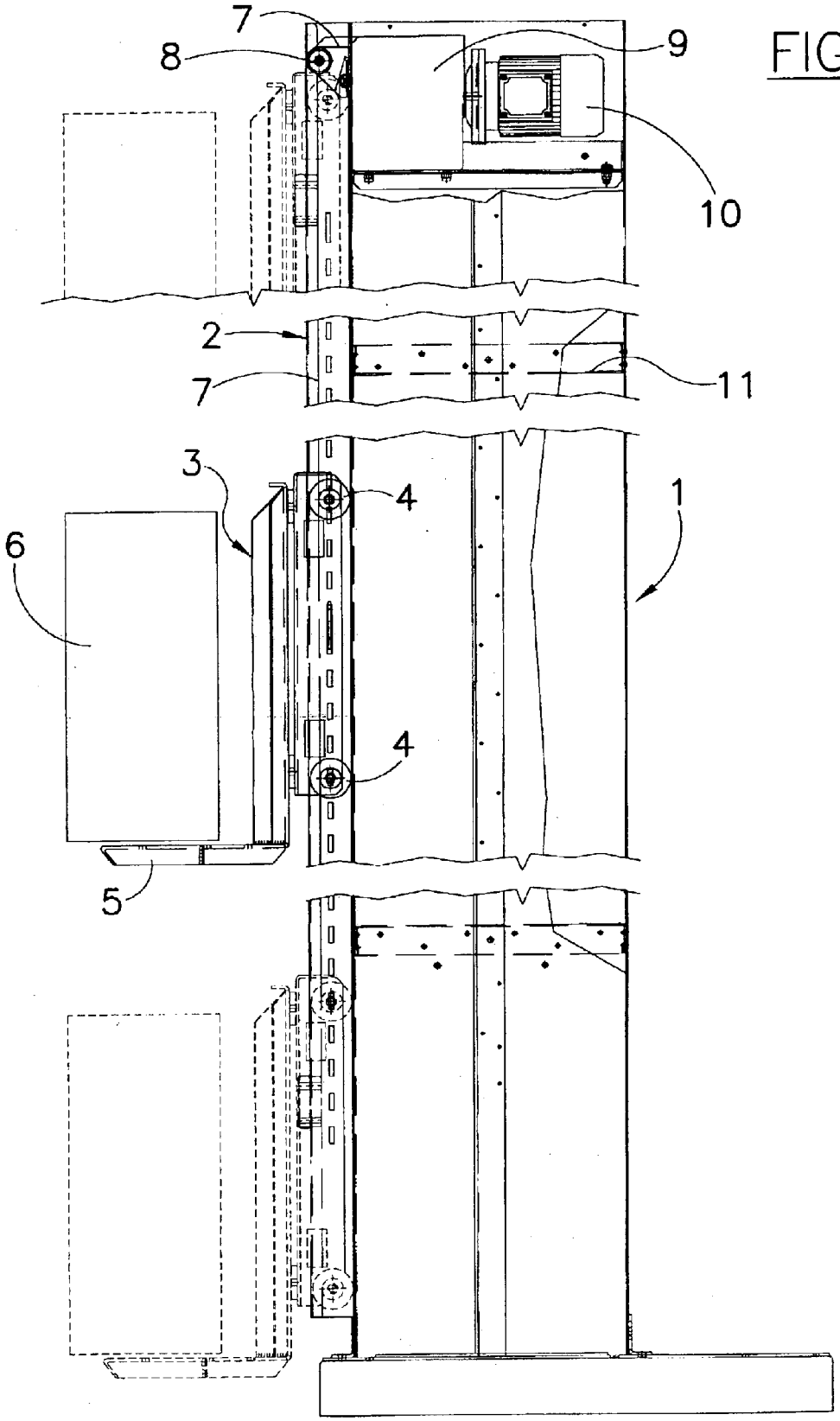
FIG. 1 shows an elevation view of a column for fixed column and rotating platform winding apparatus, that includes a locking device of the reel-holder trolley in accordance with the present invention.

In FIG. 1 the column of a fixed column and rotating platform winding apparatus is shown and indicated with the numerical reference 1.

Along a wall of the column 1 is positioned and fastened the back wall 24 of a vertical sliding guide 2 with side walls 25 (FIG. 4), in which slide the wheels 4 of a trolley 3, that carries a support base 5 for a reel 6 of windable tape, in particular for a reel of film.

The trolley 3 is suspended to a hoisting belt 7, which at the top of the column 1 is deviated by a pulley 8 inside a winding-unwinding mechanism 9 constituted substantially by a winch (not shown) activated by a motor 10.

Figure 2:
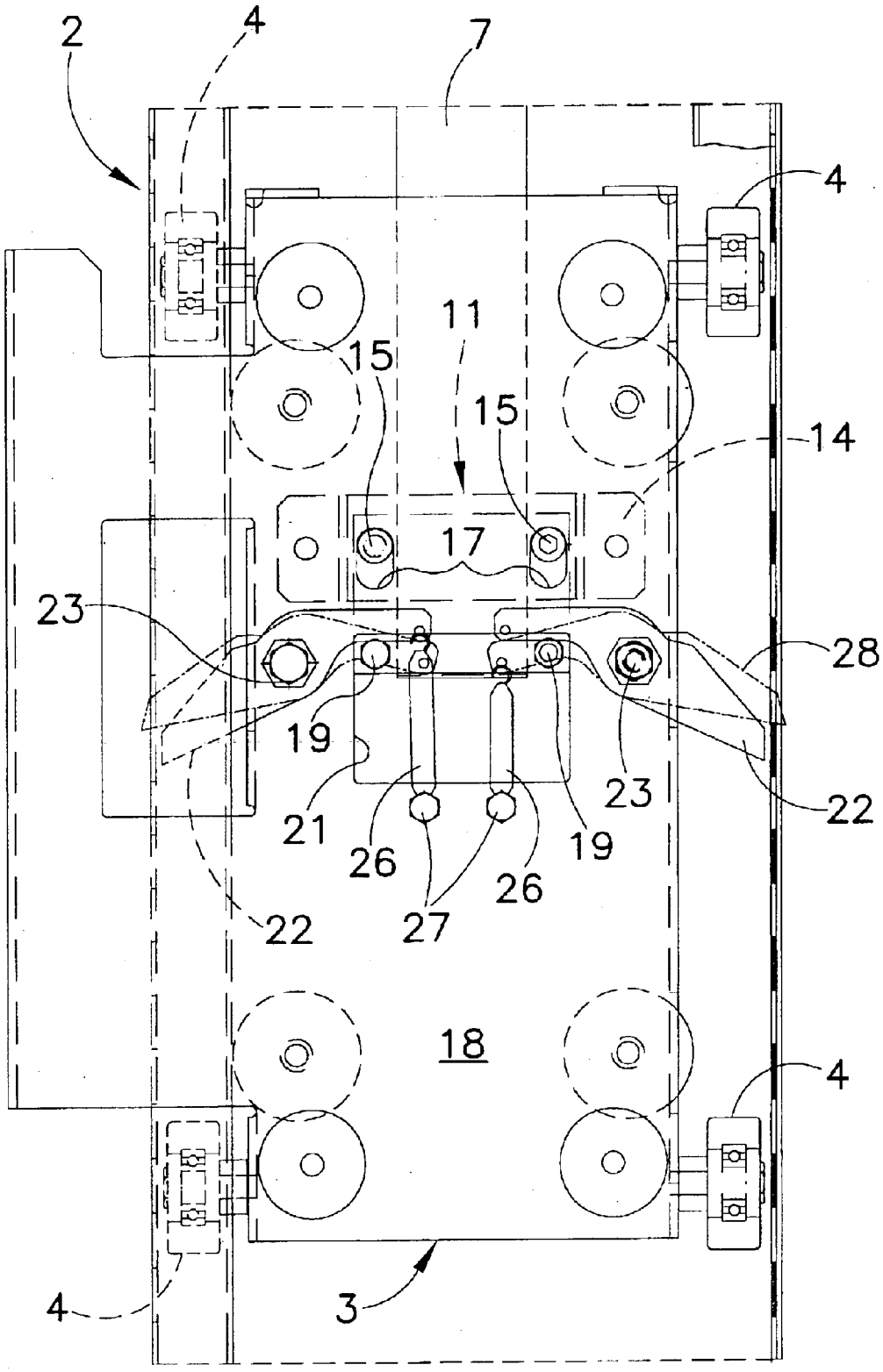
FIG. 2 shows the reel-holder trolley with relative locking device seen from left with respect to FIG. 1.
Figure 3:
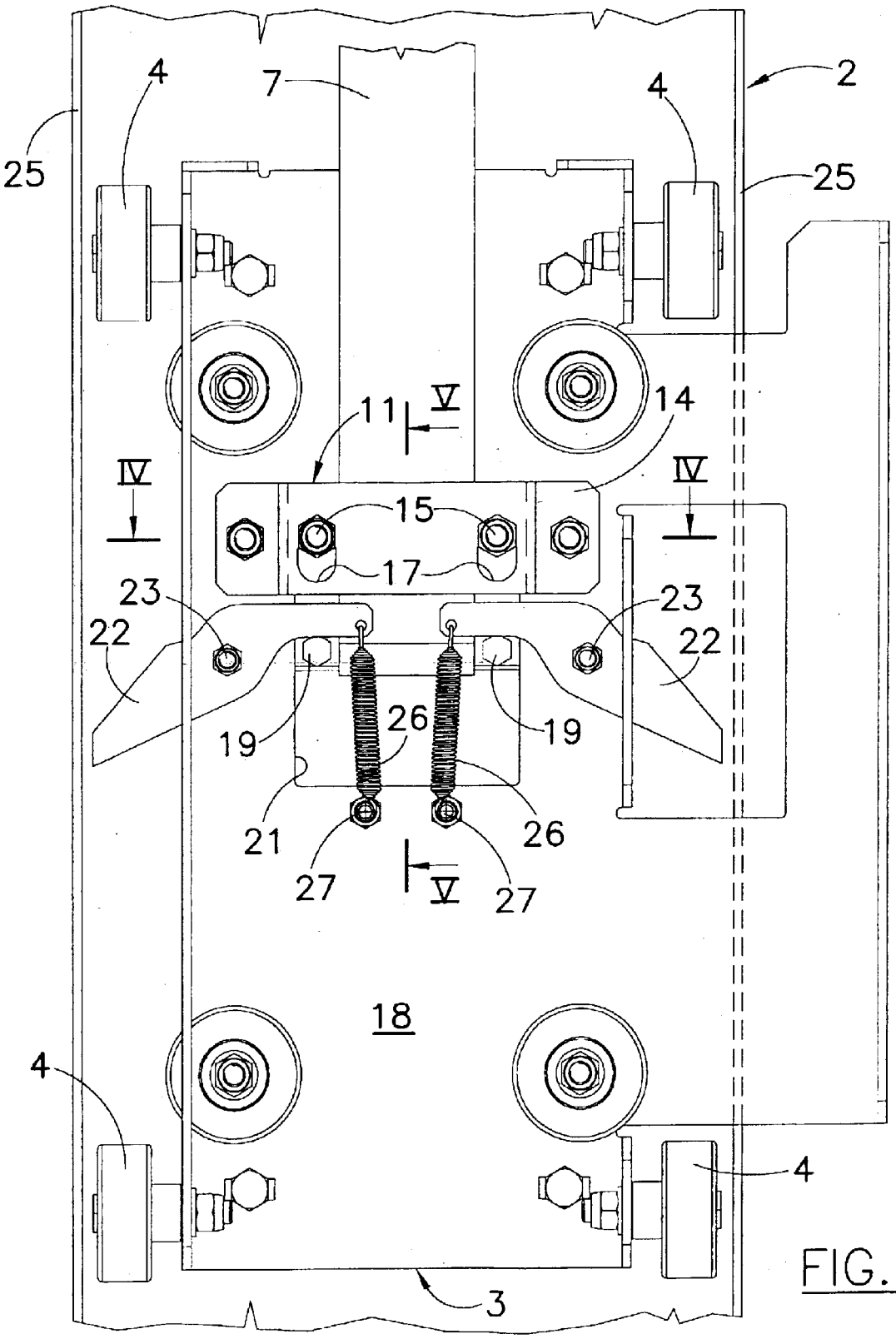
FIG. 3 shows the reel-holder trolley seen from behind with respect to FIG. 2.
Figure 4:
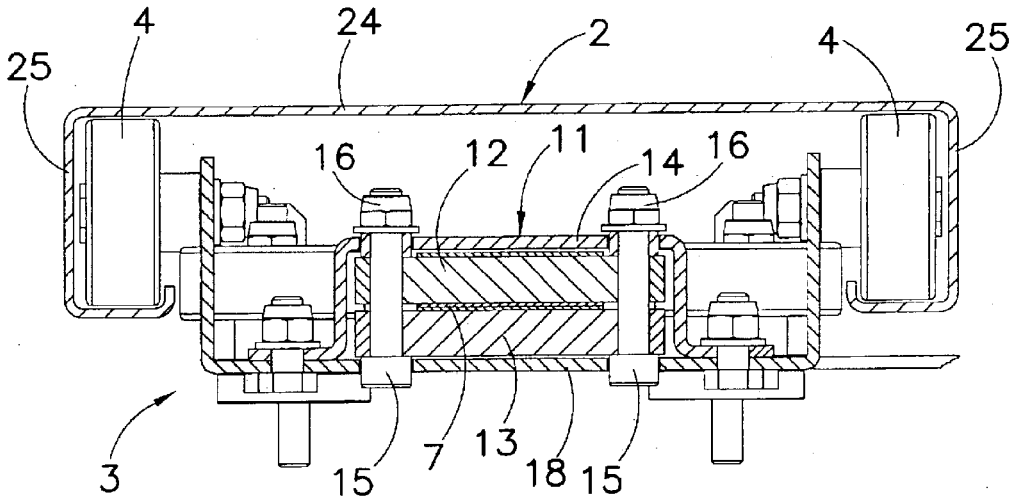
FIG. 4 shows said trolley and relative locking device in transversal section according to line IV—IV of FIG. 3.
Figure 5:
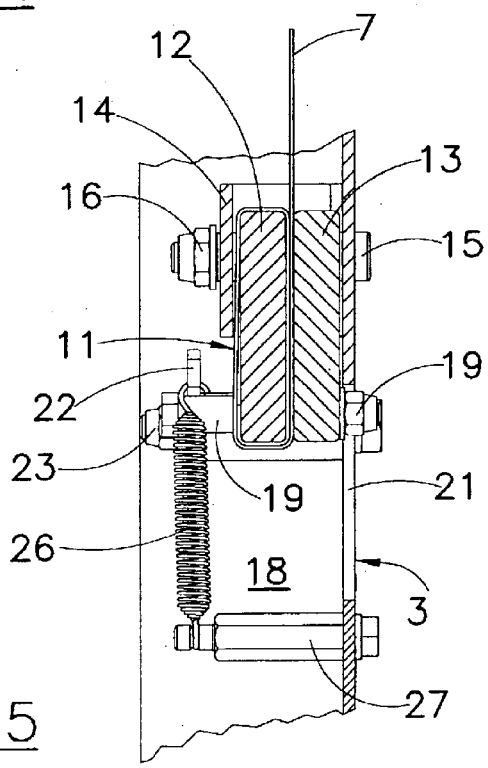
FIG. 5 shows said trolley and relative locking device in longitudinal section according to line V—V of FIG. 3.

The details of the trolley 3 and of its connection to the belt 7 can be seen in the FIGS. 2–5, in which it can be seen that the lower end of the belt 7 is held by a clamp 11 constituted by two bars placed side by side 12 and 13, on the first of which the belt 7 winds, while the second acts as clamping organ thanks to the bolts 15 with nuts 16 (FIGS. 4 and 5).

The bolts 15 are housed and slides in vertical slots 17 of a plate 14 with turned back wings that is fastened to the body 18 of the trolley 3. The clamp 11 thus results moveable in relation to the body 18 of the trolley between the raised position illustrated in the FIGS. 3 and 4 and a lowered position, in which the bolts 5 are in contact with the lower ends of the slots 17.

Two horizontal pins 19 are firmly fastened to the clamp 11, which in turn slide vertically inside a window 21 between the raised position of the FIGS. 2, 3 and 5 and a lowered position. In the raised position the pins 19 act on a pair of levers 22 with the fulcrum in 23 on the body 18 of the trolley 3 so as to keep them, against the action of springs 26 attached to 27 to the body 18 of the trolley, in the slightly opened out position illustrated in FIG. 3 and, in a continuous line, in FIG. 2; in this position the levers 22 do not interfere with the side walls 25 of the guide 2. In the lowered position corresponding to the lowered position of the clamp 11, instead, the two pins 19 free the levers 22, that are then forced by the springs 26 to return to the more opened out position illustrated in dashes and dots in FIG. 2; in this position the levers 22 enter openings 28 of the side walls 25 of the guide 2 to lock the vertical sliding of the trolley 3.

In the normal operating of the trolley 3 and of the relative hoisting device the clamp 11 with its bolts 15 and pins 19 is held in a raised position by the upward traction of the belt 7 and in turn keeps the levers 22 in such a position as not to interfere with the side walls 25 of the guide 2 and thus leaves the trolley 3 free to slide in the guide 2.

In the event of the belt 7 breaking, or other accident tending to make the trolley 3 fall, the clamp 11, no longer pulled upward, descends with the bolts 15 along the slots 17 and consequently the pins 19 free the levers 22, that under the elastic action of the springs 26 open out, engaging the openings 28 of the side walls of the guide 2 and thus locking the descent of the trolley 3.

What is claimed is:

1. Locking device for descent of a reel-holder trolley along a sliding guide under control of a traction belt in a fixed column winding apparatus, said locking device comprising a clamp for connecting the belt and the trolley, the clamp being attached to the belt and being mobile with respect to the trolley between a first raised position in which the clamp is held by the upward traction exerted by the belt and holds in turn a pair of levers in such a position as not to interfere with side walls of the sliding guide of the trolley and a second position in which the clamp moves automatically by gravity in the event the traction of the belt is released and permits said pair of levers to be elastically stressed in such a position as to transversally enter openings of side walls of the sliding guide of the trolley to lock the descent of the trolley.

2. Device according to claim 1, wherein said clamp includes a pair of bolts sliding in vertical slots of a body of the trolley and in addition fitted with a pair of pins, which with the clamp in a raised position keeps said levers in a slightly opened out position against the action of springs, while with the clamp in a lowered position they free said levers enabling the springs to force them into a more opened out position in which they engage in said openings of the guide.

3. Device according to claim 2, wherein said pins are housed sliding in a window of the body of the trolley.

* * * * *